US006785924B1

(12) United States Patent
Rogers et al.

(10) Patent No.: US 6,785,924 B1
(45) Date of Patent: Sep. 7, 2004

(54) METHOD OF ORIENTING SHOES IN A WASHING MACHINE AND DEVICES FOR ALIGNING SHOES IN A WASHING MACHINE

(75) Inventors: Steven Barrett Rogers, Cincinnati, OH (US); Kathleen Anne Perry, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/666,113

(22) Filed: Sep. 20, 2000

(51) Int. Cl.[7] ..... D06F 35/00

(52) U.S. Cl. ..... 8/159; 68/235 R; 68/13 R

(58) Field of Search ..... 68/25, 48, 140, 68/139, 13 R, 213, 235, 235 R; 8/158, 159

(56) References Cited

U.S. PATENT DOCUMENTS

| | | | | | |
|---|---|---|---|---|---|
| 1,743,799 | A | * | 1/1930 | Patterson | 68/144 |
| 2,133,584 | A | * | 10/1938 | Spanel | 8/137 |
| 4,388,739 | A | * | 6/1983 | Martinon et al. | 8/150 |
| 4,418,699 | A | * | 12/1983 | Chen | |
| 4,435,964 | A | * | 3/1984 | Misawa | |
| 4,630,312 | A | * | 12/1986 | Milstein | 383/86 |
| D294,757 | S | * | 3/1988 | Kahane et al. | D32/36 |
| 4,818,242 | A | | 4/1989 | Burmeister et al. | |
| 5,276,979 | A | | 1/1994 | Gordon, Sr. | |
| 5,336,419 | A | | 8/1994 | Coffindaffer et al. | |
| 5,707,435 | A | | 1/1998 | Halloran | |
| 5,746,514 | A | * | 5/1998 | Orensten | 383/66 |
| 5,749,248 | A | * | 5/1998 | Kim | |
| 5,803,605 | A | * | 9/1998 | Masi | 383/38 |
| D404,177 | S | * | 1/1999 | Lewis | D32/36 |
| 5,881,412 | A | * | 3/1999 | Ziskind | 8/159 |
| 6,067,729 | A | * | 5/2000 | Willis | |
| 6,114,299 | A | | 9/2000 | Hunter et al. | |
| 6,134,810 | A | * | 10/2000 | Stockley | |
| 2002/0108186 | A1 | * | 8/2002 | Williams | 8/159 |

FOREIGN PATENT DOCUMENTS

| | | | |
|---|---|---|---|
| DE | 2631419 | | 2/1977 |
| DE | 19858353 | | 9/2000 |
| EP | 0394689 | A3 | 3/1990 |
| EP | 0394689 | A2 | 3/1990 |
| EP | 0450816 | B1 | 3/1991 |
| EP | 0450816 | A1 | 3/1991 |
| FR | 2774382 | | 8/1999 |
| GB | 1549180 | | 8/1979 |
| JP | 10-57668 | * | 3/1998 |
| JP | 10211390 | | 8/1998 |
| JP | 2000-23897 | * | 1/2000 |
| JP | 2000-23877 | * | 2/2000 |
| JP | 2000-167287 | * | 6/2000 |
| JP | 2000-229197 | * | 8/2000 |
| WO | WO9932539 | | 7/1999 |

* cited by examiner

*Primary Examiner*—Frankie L. Stinson
(74) *Attorney, Agent, or Firm*—Jeffrey V. Bamber; Kim William Zerby; Steven W. Miller

(57) ABSTRACT

A method of orienting shoes in a washing machine, and devices for aligning shoes in a washing machine are disclosed. The method of orienting shoes in a washing machine, and devices for aligning shoes in a washing machine reduce the time for drying the shoes after the washing process.

18 Claims, 5 Drawing Sheets

METHOD OF ORIENTING SHOES IN A WASHING MACHINE AND DEVICES FOR ALIGNING SHOES IN A WASHING MACHINE

FIELD OF THE INVENTION

The present invention relates to a method of orienting shoes in a washing machine, and devices for aligning shoes in a washing machine. More particularly, the present invention relates to a method of orienting shoes in a washing machine, and devices for aligning shoes in a washing machine that reduce the time for the drying the shoes after the washing process.

BACKGROUND OF THE INVENTION

In the past, people have washed athletic shoes, particularly those made of canvas, in conventional washing machines for the purpose of cleaning these shoes. In most cases, the shoes are simply thrown into a washing machine, and the machine is operated in the usual matter:

However, a shoe, in particular an athletic shoe, which is exposed to the wash cycle of a washing machine, especially the agitation and spin portions of the wash cycle, can suffer undesirable damage in the form of surface abrasions (from the agitator, washer tub, other articles, etc.), fiber pilling, and the formation of fibrils or slender fibers in and around the sock liner and shoe laces. Such damage is often visually unacceptable to consumers and can shorten the wearable life of a shoe.

A number of patents have been directed to cleaning shoes in conventional washing machines, as well as in machines specially-designed for washing shoes. These include: U.S. Pat. No. 4,435,964 issued to Misawa; U.S. Pat. No. 4,637,231 issued to McMillan, et al.; U.S. Pat. No. 5,749,248 issued to Kim; and U.S. Pat. No. 5,862,684 issued to Park.

One major drawback with known methods used for washing shoes is that it takes an inordinate amount of time for the shoes to dry after they are washed. This makes it inconvenient for most people to wash their shoes in such a manner. Typically such prior methods will take between one and three hours to dry in a conventional clothes dryer.

Thus, a need exists for devices for protecting shoes from damage when they are washed in a washing machine.

A need also exists for a method of washing shoes in a washing machine that greatly reduces the time needed to dry the shoes after the washing process.

Therefore, it is an object of the present invention to provide methods and devices for washing shoes in a washing machine that protects the shoes from damage during the washing process, and greatly reduces the time needed to dry the shoes after the washing process.

These and other objects of the present invention will become more readily apparent when considered in reference to the following description and when taken in conjunction with the accompanying drawings.

SUMMARY OF THE INVENTION

This invention relates to a method of orienting shoes in a washing machine, and devices for aligning shoes in a washing machine. More particularly, the present invention relates to a method of orienting shoes in a washing machine, and devices for aligning shoes in a washing machine that reduce the time for the drying the shoes after the washing process. The method can be used in a conventional washing machine, or in a washing machine that is specially designed to orient the shoes in the desired orientation. In one non-limiting embodiment, the method of cleaning shoes in a washing machine comprises the steps of:

(a) providing a washing machine having a tub;

(b) providing at least one shoe having a sole;

(c) providing a device for orienting the shoe(s) in the tub of the washing machine, which maintains the shoe(s) in a particular orientation throughout the washing process;

(d) positioning the device in the tub of the washing machine with the shoe(s) therein; and (e) operating the washing machine through a washing process.

The shoes can be placed in any desired orientation, however, in a vertical axis washing machine, it is preferable that the shoe(s) is/are placed in the washing machine the sole(s) facing upward. It is also preferable that the shoe(s) be oriented so that the toes of the shoes are pointing in the same direction that the agitator rotates during the spin cycle of the washing machine. Without wishing to be bound to any particular theory, it is believe that these orientations will reduce the amount of water that is capable of remaining in the shoe(s) and/or will orient the shoe(s) such that water can be ejected best from the inside of the shoe(s) during the washing machine's spin cycle.

A non-limiting number of devices are disclosed for maintaining the shoes in the desired orientation in the washing machine. In one embodiment, the device comprises a flexible, porous bag that is designed to hold the shoes in the desired position throughout the wash cycle.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in conjunction with the accompanying drawings, in which:

DETAILED DESCRIPTION OF THE INVENTION

This invention relates to a method of orienting shoes in a washing machine, and devices for aligning shoes in a washing machine. More particularly, the present invention relates to a method of orienting shoes in a washing machine, and devices for aligning shoes in a washing machine that reduce the time for the drying the shoes after the washing process. The method can be used in a conventional washing machine, or in a washing machine that is specially designed to orient the shoes in the desired orientation.

The devices for orienting the shoes can be, and preferably are used during the process of washing the shoes in the washing machine. It is also possible to first use the devices after the shoes are washed in a washing machine, using the washing machine's spin cycle to eject excess water from inside the shoes. Preferably, however, the devices are used during the wash cycle as well.

Devices for Aligning the Shoes in the Washing Machine

Figure 1:
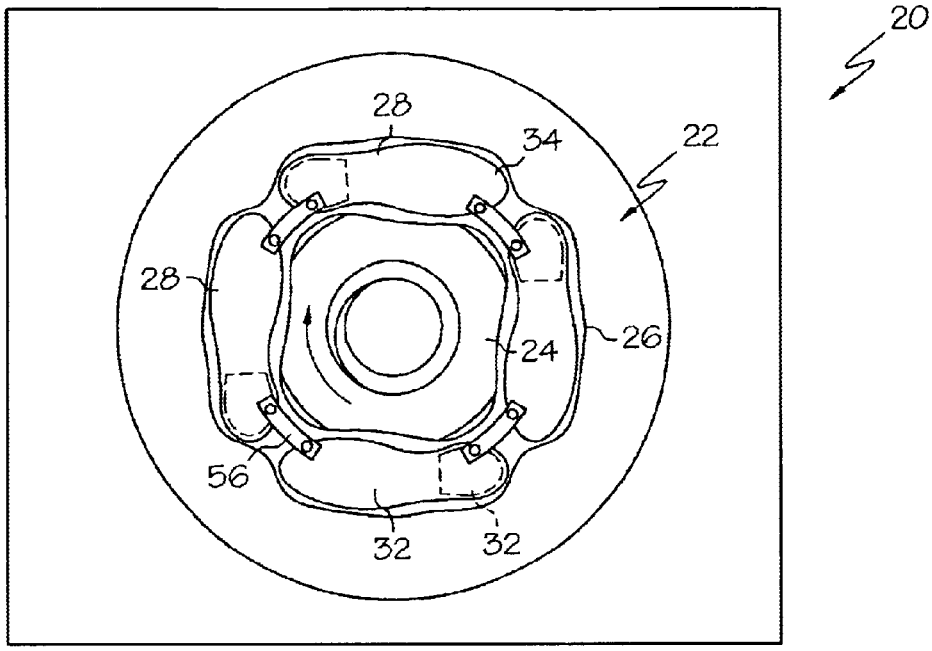
FIG. 1 is a top view of a washing machine showing one embodiment of a device for orienting the shoes therein.

FIG. 1 shows a washing machine 20 with one non-limiting embodiment of a device therein for orienting the shoes in the machine. The washing machine 20 includes a tub 22 and an agitator 24. In the embodiment shown in FIG. 1, the device for aligning the shoes in the washing machine is a flexible container, preferably a containment bag 26 for the shoes 28. The devices of the present invention, however, are not limited to flexible containment bags 26. Other types of devices for aligning the shoes in the washing machine are also contemplated.

The containment bag 26 should align the shoes in the tub 22 of the washing machine 20 in an orientation that reduces, and preferably minimizes the amount of water that enters the openings 30 of the shoes for the wearer's feet and the amount of water that remains in the inside of the shoes 28 after the washing process.

The containment bag 26 can be in any suitable configuration. The containment bag 26 can be of any convenient size, and preferably is sufficiently large to allow movement of the containment bag and shoe(s) contained therein, such as during agitation by a mechanical agitator in a conventional automatic washing machine, but should not be so large as to interfere with the operation of the mechanical agitator. Without wishing to be bound by any particular theory, movement of the containment bag 26 in the tub 22 of the washing machine is believed to promote the flow of water through the bag to improve cleaning of the shoe(s).

In the embodiment shown in FIG. 1, the containment bag 26 is a flexible bag designed for protecting the shoes from being damaged by the action of the agitator 24 during the washing operation. The containment bag 26 can hold any suitable number of shoes 28. The containment bag 26 shown in FIG. 1 is capable of holding four shoes 28. In the top loading, vertical axis washing machine 20 shown in FIG. 1, the shoes 28 are placed in the containment bag 26 with the soles 32 facing upward. It is also preferable that the shoe(s) 28 be oriented so that the toes 34 of the shoes are pointing in the same direction that the agitator 24 rotates during the spin cycle of the washing machine.

FIGS. 2–5 show one embodiment of a containment bag 26 in greater detail. The containment bag 26 is a mesh bag that has at least one compartment or pocket, and preferably has a plurality of pockets 36, for receiving shoes. The containment bag 26 shown in FIGS. 2–5 is preferably formed of a mesh material.

The mesh material preferably has sufficient open area for removal shoe contaminants such as dirt, mud, clay, and grass during the wash cycle. The mesh walls should also have sufficient strength to withstand the forces imparted by a water-soaked shoe during the wash process. For instance, leather athletic shoes can weigh 600 gms or more when soaked with water such that significant loading can be imparted to a shoe bag in its three axes during wash and spin cycles. Mesh walls having a dry tensile strength of at least about 800 gms/cm$^2$ and, more preferably, between about 800 gms/cm$^2$ and about 3500 gms/cm$^2$, when measured according to the Tappi 494 om-88 method, in combination with sufficient aperture open area provides a shoe bag which can withstand the rigors of washing shoes while allowing adequate removal of the shoe contaminants.

The containment bag 26 may be manufactured from any suitable material, such as polyester, nylon, polypropylene, cotton, and the like. The containment bag 26 can be formed from layered, or non-layered materials so long as the material provides suitable protection for the shoe from abrasion. The containment bag 26 also is preferably made of a material that has enough integrity so that no portions of the bag 26 roll over and change the orientation of the shoes in any undesirable way during the wash cycle.

In one non-limiting embodiment, the material used for the containment bag is an apertured 100% polyester material which comprises two integral knit plies or layers, which is known as a double needle bar material. Suitable double needle bar materials include 1 and 2 bar-double needle bar materials. (The term "bar refers to the number of threads that connect the different "layers".) Such a material is available from Milliken & Company of Spartanburg, S.C., USA as style No. 961335.

This material has two sides, each with different size openings (or apertures) therein. The apertures are sized to allow sufficient wash water to flow therethrough, even when contaminated with particulate material and substances which are commonly encountered when wearing and washing shoes, such as dirt, grass, small rocks and pebbles, and the like. For example, grass and other foliage (which can be several centimeters or more in length or width) and dirt, soil, clay, and the like (which can form into clump which are several centimeters or more across) may need to flushed or removed from a containment bag 26 during the wash cycle.

One side of this material has a plurality of large, oval-shaped openings or apertures. Several of these are shown by reference number 52 in FIG. 3. The other side has a plurality of relatively smaller sized openings therein. Several of these are shown by reference number 54 in FIG. 2. The openings can be of any suitable size. Preferably, the openings range in size from between about 0.1 mm and about 20 mm, as measured across the openings, although smaller and larger sized openings can also be used.

Figure 2:
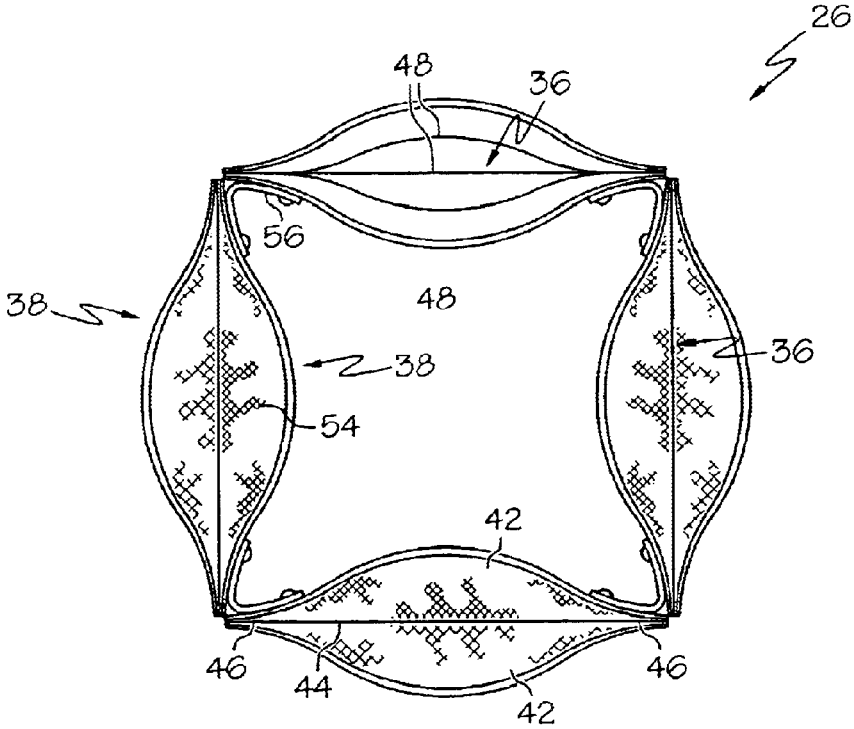
FIG. 2 is a top view of the containment bag shown in FIG. 1 without the hoes therein.
Figure 3:
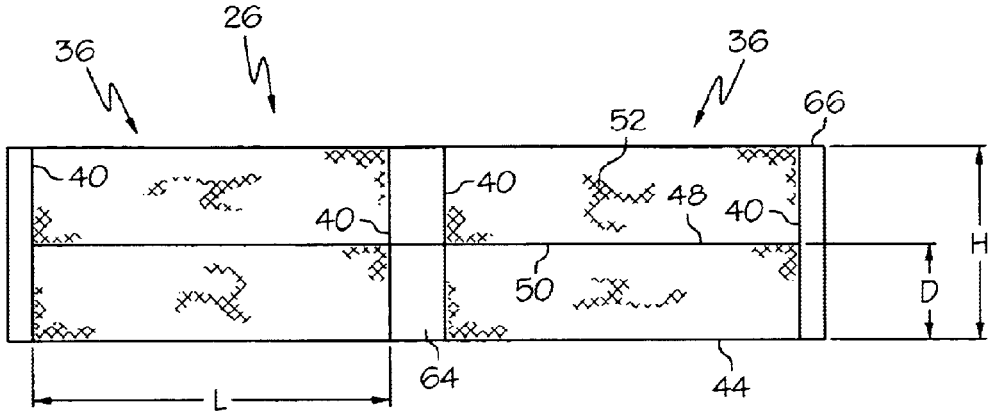
FIG. 3 is a side view of the outside of the containment bag shown in FIG. 1 in flattened condition.
Figure 4:
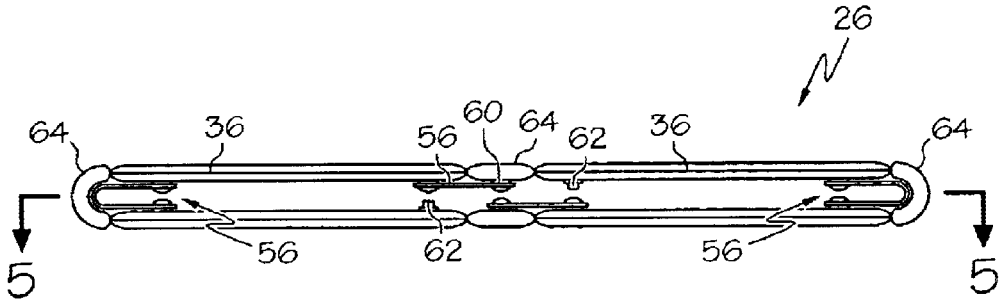
FIG. 4 is a top view of the containment bag shown in FIG. 3.
Figure 5:
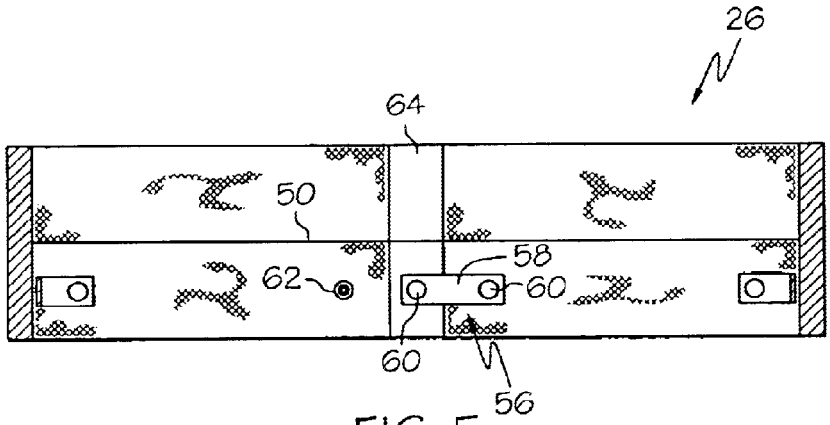
FIG. 5 is a side view of the inside of the containment bag shown in FIG. 4, as viewed from a section taken along line 5—5 in FIG. 4.

It should be understood that only a few apertures are shown in FIGS. 2 and 3 for simplicity of illustration. The apertures 52 and 54 can be provided in any suitable locations on the bag. Preferably, the apertures 52 and 54 shown are distributed over substantially the entire surfaces of the containment bag 26. The containment bag 26 is made so that the side of the material with the larger oval openings 52 is preferably on the outside of the containment bag 26.

Materials having other aperture shapes and sizes can be used if desired. Further, the size and shape of the apertures can vary in any suitable manner.

The containment bag 26 can be made in any suitable manner. In the embodiment shown in the drawings, the containment bag 26 is made from at least one web of material that is arranged to have two opposed portions, and the opposed portions are joined together to form several pockets. The containment bag 26 shown in FIGS. 2–5 is preferably made of a single web of the above-described mesh material that is folded in half lengthwise and joined together by a method, such as by stitching, at appropriate places to form the pockets 36. In the embodiment shown in FIGS. 2–5, the web of material is folded into two halves 38 (shown in FIG. 2). The web of material shown in this embodiment, is provided with vertical stitching lines 40 (shown in FIG. 3) for separating the folded web into pockets 36 for the shoes. The stitching forms the folded web into a structure having two side walls 42, a bottom 44, and two ends 46 for each shoe pocket as shown in FIG. 2. Additional stitching can be used to form a border around the top of the containment bag.

A small horizontal pleat 48 (shown in FIGS. 2, 3, and 5) is preferably also formed into the web of material, preferably before the web of material is folded in half as described above. This horizontal pleat 48 provides the sides of the containment bag 26 with a structure for holding the shoes in place in the desired orientation in each pocket 36 of the shoe bag 26 during the washing process (e.g., to "lock"the soles of the shoes in an upward-facing position). The horizontal pleat 48 is preferably held in place by a horizontal line of stitching 50.

In other embodiments, a suitable containment bag can be made in many other manners. For example, it is not necessary that the containment bag be formed from a single web of material. More than one web or piece of material can be joined together to form the containment bag. In other embodiments, the containment bag need not have a bottom and sides that are formed in the above-described manner. For instance, separate pieces of material can be used to form these portions of the pockets, and the pockets can be provided with flatter panels to form their bottom and/or end walls.

The containment bag 26 can have any suitable dimensions. In one embodiment, the height, H, of the containment bag 26, which is measured from the fold that forms the bottom 44 of the containment bag to the top edge 66 of the containment bag, is about 8½ inches (about 21.5 cm). The distance, D, from the fold 44 at the bottom of the containment bag to the horizontal pleat 48 (and horizontal line of stitching 50) is preferably about 3¾ inches (about 9.5 cm). The length of each shoe pocket, as measured between the inner vertical stitching lines 40, is preferably about 13 inches (about 33 cm). Preferably, there is a space 64 (also formed by stitching 40) between the ends of the shoe compartments to permit the shoes to be placed into the pockets around the washing machine agitator without such a close fit between shoes that the shoes pinch each other when the shoes are placed in the containment bag 26, and the containment bag 26 is oriented in its circular "donut"configuration and placed around the agitator. In one embodiment, this space may be about 2 inches (about 5 cm) in width.

The embodiment of the containment bag 26 shown in FIGS. 1–5 is also preferably provided with elements that hold the shoe compartments in the desired relationship around the washing machine agitator 24. These elements preferably configure the containment bag 26 so that the pockets 36 are arranged on opposite sides (around) the washing machine agitator. The bag 26 can, thus, be formed into a donut configuration. In the embodiment shown, the elements that hold the shoe compartments in the desired relationship are snap fastening systems 56 that join the pockets or compartments 36, and maintain a degree of tension between the compartments so that the containment bag 26 remains in the desired configuration.

The snap fastening systems 56 preferably comprise a strip of material 58 with female snap fastening elements 60 thereon. In one embodiment, the strip of material 58 is about 2½ inches (about 6.25 cm) long. The female snap fastening elements 60 preferably engage with male snap fasteners 62 that are located on the outside surface of the containment bag 26. The male snap fasteners 62 are located on the interior portion of the containment bag 26 when it is in its circular "donut"configuration. In this embodiment, the male snap fastening elements 62 are preferably spaced about 4½ inches (about 11 cm) apart. The male snap fasteners 62 are preferably located on opposite sides of space 64. In one embodiment, the male snap fasteners 62 are located about 1½ inches (about 3.8 cm) above the fold at the bottom of the containment bag 26.

In other embodiments,: the positions of the male and female snap fasteners can be reversed so that female snap fasteners are in the positions shown for the male snap fasteners and vice versa. In still other embodiments, any other suitable type of fastening systems could be used for the purpose described herein, or some other type of element or structure can be used for this purpose.

The containment bag 26 can also be provided with optional openings to provide an outlet for the wash water such that shoe contaminants can be removed from the interior of the containment bag 26.

Numerous alternative embodiments can be provided for aligning the shoes in the washing machine to reduce the amount of water retained therein. The shoes may also be in other orientations depending on the configuration of the device and the type of washing machine.

For example, the containment device could comprise more than one containment bag of the type shown in FIGS. 1–5. Such a device could comprise two or more of these containment bags stacked on top of one another (and preferably joined together) to form a multi-level bag having first and second level compartments (and additional level compartments, if desired).

Figure 6:
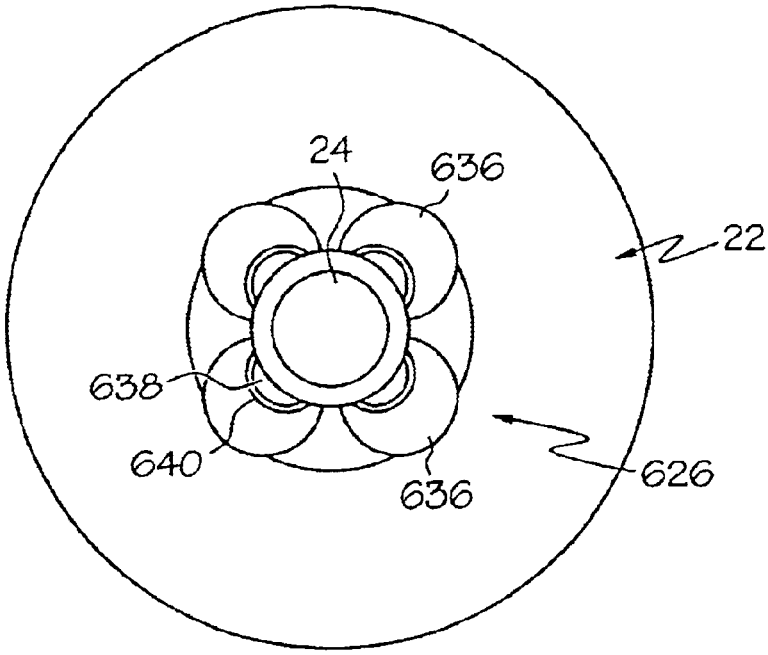
FIG. 6 is a top view of an alternative containment device for aligning shoes in a washing machine.
Figure 7:
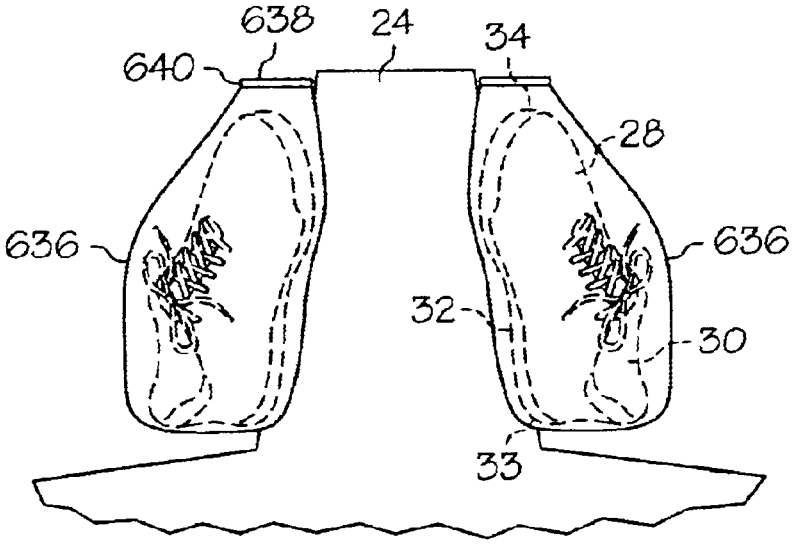
FIG. 7 is a side view of the containment device shown in FIG. 6.

FIG. 6 shows another embodiment of a containment device 626 which comprises a plurality of flexible mesh pockets 636 that can fit around the washing machine agitator 24. The mesh pockets 636 preferably have an opening 638 with an elastic band 640 around the tops thereof to retain the shoes 28 in the pockets 636 during the washing process. The shoes 28 are preferably placed in the mesh pockets 636 of the device 626 shown in FIG. 6 with the heels 33 in first (that is, the heels 33 are at the bottom of the pockets 636), and the soles 32 facing inward toward the agitator 24. This orientation has the advantage that the water in the interior of the shoes will drain down into the heel area during the washing machine's spin cycle, and the spin cycle will cause the water to be propelled out of the shoes.

It is desirable to provide devices so that the methods described herein will be suitable for use in the various types of washing machines in use throughout the world. These methods may, therefore have adaptations that make them more suitable for use in the following: high agitation top loading vertical axis washing machines such as those used in the United States; the longer wash cycle, higher water temperature horizontal axis front loading washing machines used in Europe; the relatively mild agitation/short wash cycle washing machines used in Japan; and, other types of washing machines used elsewhere.

Methods of Cleaning Shoes in a Washing Machine

The methods of cleaning shoes described herein can be used to clean various types of shoes, including, but not limited to athletic shoes (e.g., running shoes, basketball shoes, cross-training shoes, tennis shoes, bowling shoes, and other types of athletic shoes that are preferably not provided with metal cleats), whether they be made out of leather, nylon, canvas, mesh, or the like, and combinations thereof, and shoes made out of similar materials, and having a similar construction, such as shoes worn by hospital employees, and the like.

The shoes can be cleaned in any suitable manner in the washing machine using any suitable cleaning and/or conditioning composition, and as long as the methods and devices described herein ate utilized, the benefits of protecting the shoes and reducing the time for drying the shoes after the washing process will be achieved.

A preferred method for treating shoes comprises contacting the shoes with one or more treating compositions and subsequently washing the shoes in an aqueous medium.

One or more treating compositions may be applied to the shoes prior to washing the shoes. Additionally, one or more treating compositions may be applied to the aqueous medium used to wash the shoes. Also, one or more treating compositions may be contained within the containment bag, and be either releasably fixed to the interior walls of the bag or delivered into the interior of the bag before or after placing the shoe in the bag. Further, one or more treating compositions may be applied to the shoes prior to placing the shoes in the bag. Agitation of the aqueous medium containing the shoe to be treated facilitates and expedites the treatment by permitting the treating compositions to diffuse onto and inside the shoe. The steps of the methods of treating the shoes depends upon the aqueous medium and benefit desired to be achieved by treating the shoes.

In one non-limiting embodiment, the method cleans, deodorizes, and conditions leather-containing athletic shoes in a conventional home washing machine.

The cleaning system comprises a liquid conditioner for mitigating the effects on leather shoe surfaces as a result of washing the shoes in an aqueous medium, and a cleaning gel for cleaning the outside of the shoes. The treating composition may be applied directly to the exterior surfaces of the shoes, the interior surfaces of the shoes and/or both, preferably by using an applicator if desired. Rubbing of the treating composition onto the surfaces of the shoe may expedite treatment of the surfaces of the shoe and is thus preferred.

In this embodiment, the cleaning gel is applied to the outside of the shoes directly from a brush applicator on top of the cleaning gel bottle. The liquid conditioner is poured inside the shoe through the opening in the shoe (in which the wearer's foot is inserted), and the shoe is rocked back and forth to distribute the conditioner. The shoes are then placed inside the pockets of the containment bag described above with the soles facing upward. The containment bag with the shoes therein is then placed into a washing machine. The washing machine is turned on and the shoes are washed.

Preferably, the temperature of the aqueous wash medium used to wash the shoes is no more than about 180° F. (82° C.), more preferably no more than about 150° F. (66° C.), most preferably no more than about 110° F. (43° C). Without wishing to be bound by any particular theory, higher temperatures are believed to enhance cleaning performance, however, those same high temperatures may cause excessive damage to the shoes. Chromium can be extracted from leather to a greater extent at higher temperatures and/or damage to shoes increases as temperature of wash solutions increase.

Preferably, the wash solution comprising the treating composition(s) has a pH in the range of from about 3 to about 11, more preferably from about 4 to about 10 and most preferably from about 6 to about 9. Without wishing to be bound by any particular theory, higher pH's are believed to enhance cleaning performance, however, those same high pH's may cause excessive damage to the shoes. Techniques for controlling pH at recommended usage levels include the use of buffers, alkalis, acids, etc., and are well known to those skilled in the art.

The shoes are then dried. The shoes can be dried in any suitable manner, such as by: air drying, drying in a clothes dryer, or drying with an implement, such as a hair dryer.

The compositions used to treat the shoes can be any suitable composition(s) that will aid in cleaning and/or conditioning the same. The following example formulations are meant to exemplify compositions that can be used in the method described herein, but are not meant to limit the scope of the invention.

FORMULATION EXAMPLE 1

A cleaning agent-containing treating composition that can be used on shoes comprising at least some leather portions in accordance with the present invention can be formulated in the form of a gel as follows:

| | formula % |
|---|---|
| Builder (40% active)[1] | 30.48 |
| Nonionic Surfactant[2] | 12.00 |
| Silicone suds suppresser[3] | 0.3 |
| Thickener[4] | 0.2 |
| Humectant | 2.0 |
| Solvent[5] | 1.0 |
| Water | 8.0 |
| Minors (perfumes, dyes, preservatives, etc.) | 0.31 |
| Total | 100.00 |

[1]A copolymer of maleic/acrylic acid sodium salt.
[2]A suitable nonionic surfactant is commercially available under the tradename NEODOL 23-9 from Shell Chemical Company.
[3]A suitable silicone suds suppressor is commercially available under the designation DC2-3597 from Dow Corning.
[4]A suitable thickener is commercially available under the tradename THIXCIN ® thickener from Rheox, Inc. of Hightstown, N.J.
[5]A suitable solvent for maintaining the desired consistency of the composition is Trimethyl pentanediol (TMPD).

A liquid conditioning agent-containing treating composition that can be used on leather-containing shoes in accordance with the present invention is formulated as follows:

| | formula % |
|---|---|
| Conditioning Agent (30% active)[1] | 33.33 |
| Water | 65.40 |
| Anti-bacterial agent[2] | 1.0 |
| Perfume | 0.3 |
| Total | 100.00 |

[1]A suitable conditioning agent is commercially available under the tradename LUBRITAN AS from Rohm and Haas Company.
[2]Pelargonic acid.

In the case of canvas or mesh athletic shoes that do not comprise a significant amount of leather, ordinary commercially available detergents such as TIDE® laundry detergent, or if the shoes are white, TIDE® with Bleach laundry detergent, in either liquid or powder form, can be used. In addition, if the shoes do not contain leather, it is less necessary to control the temperature and pH of the wash water.

Alternatively, treating compositions can be specially formulated for canvas or mesh athletic shoes, such as in the following Example.

EXAMPLE 2

One non-limiting treating composition that is especially useful for treating canvas-containing shoes is formulated as follows:

| ingredient | weight % | weight % |
|---|---|---|
| Triacetin | 18.3% | 21.7% |
| Nonionic surfactant[1] | 21.9% | 26.1% |
| $Na_3$citrate.$2H_2O$ | 22.8% | 10.9% |
| $Na_3$citrate/$Na_2CO_3$/acrylic-maleic copolymer granule[2] | | 13.0% |
| $Na_2CO_3$ | 14.6% | 4.3% |
| EDDS[3] | 1.1% | 1.1% |
| Sodium perborate monohydrate | 11.0% | 10.9% |
| bleach activator[4] | 7.8% | 7.6% |
| Protease | 0.9% | 0.87% |
| Cellulase | 0.18% | 0.17% |
| Fluorescent whitening agent | 0.18% | 0.17% |
| Antifoam | 0.09% | 0.09% |
| Structurant[5] | 0.9% | 3.0% |
| Perfume | 0.2% | 0.2% |

[1]A suitable nonionic surfactant is commercially available under the tradename NEODOL 23-5 from Shell Chemical Company.
[2]$Na_3$citrate/$Na_2CO_3$/acrylic-maleic copolymer granule is described in PCT application Serial No. PCT/US00/21572 filed August 8, 2000.
[3]ethylenediaminedisuccinate, trisodium salt
[4]nonanoyl-6-aminoheaxanoyloxybenzenesulfonate, Na+ salt
[5]$Na_2SO_4$/sodium linear alkylbenzenesulfonate (described in PCT Publication WO 9942206 Al)

Preferably, the shoes are wetted before the composition in Example 2 is applied to the shoes.

The method and devices described herein reduce the amount of moisture (i.e., water) retained in shoes after the washing process in comparison to methods and devices in which the shoes are randomly oriented during the washing process.

Figure 8:
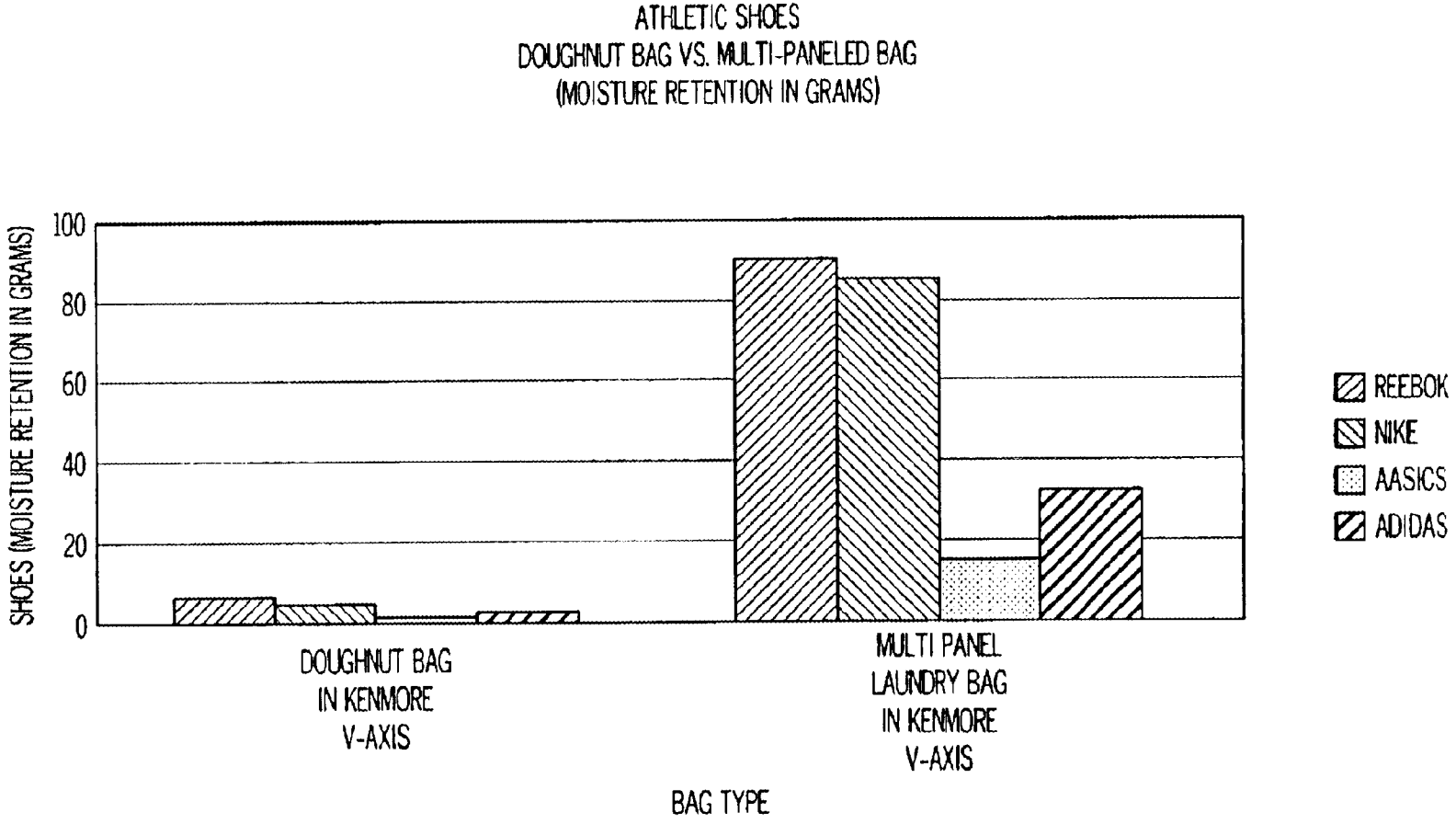
FIG. 8 is a graph which shows the standard deviation of the amount of moisture that is retained in four different types of athletic shoes when washed in the "donut bag"of the type shown in FIGS. 1–5 in comparison that same types of shoes when washed in a multi-panel laundry bag in which the shoes will be oriented in a random manner during the wash cycle.

In addition, the amount of moisture retained in shoes does not vary as greatly when using the method and devices described herein in comparison to methods and devices in which the shoes are randomly oriented during the washing process. FIG. 8 shows the reduced standard deviation in the amount of moisture retention in grams of moisture that may be present in four different types of athletic shoes (REEBOK®), NIKE®, AASICS®, and ADDIDAS® shoes) when six pairs of each type are washed in the "donut bag" of the type shown in FIGS. 1–5 in a SEARS KENMORE® vertical axis washing machine in comparison that same types of shoes when washed in a multi-panel laundry bag in which the shoes will be oriented in a random manner during the wash cycle. This is important because the time it takes for the shoes to dry will be much more consistent than in methods where the shoes are randomly oriented during the washing process.

Figure 9:
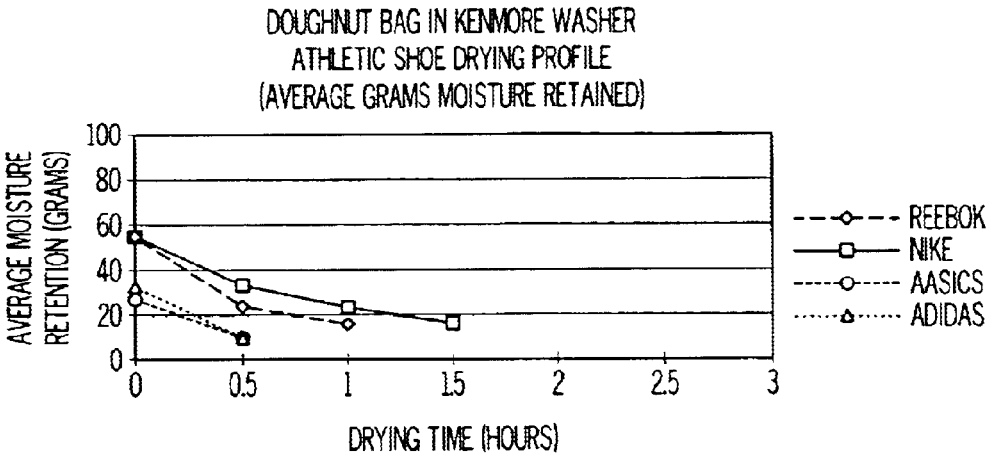
FIG. 9 is a graph which shows the relationship between the amount of moisture retained in the shoes and the drying time for the shoes when washed in the donut bag.
Figure 10:
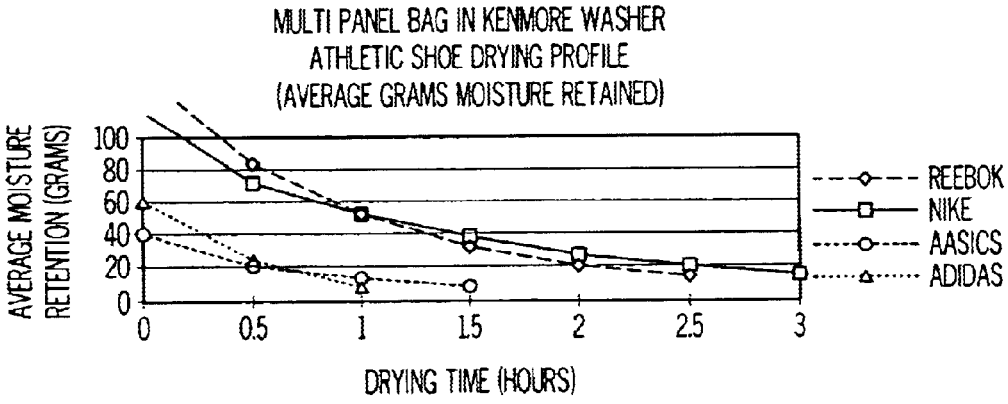
FIG. 10 is a graph which shows the relationship between the amount of moisture retained in the shoes and the drying time for the shoes when washed in a multi-panel laundry bag.

The amount of water retained in the shoes has a significant impact on the time it takes to dry the shoes. The relationship between the amount of moisture retained in the shoes and the drying time for the shoes is shown in FIGS. 9 and 10. In FIGS. 9 and 10, the initial points on the y-axis (at Drying Time=0 hours), represent the amount of moisture in the shoes when they are initially removed from the washing machine. The other points on the graph represent the amount of moisture in the shoes after drying in a conventional clothes dryer for the specified time period. The shoes are considered to be dry when there is less than or equal to about 20 grams of moisture therein.

FIG. 9 shows the relationship between the amount of moisture retained in the shoes and the drying time for the shoes when washed in the donut bag. FIG. 9 shows that the all of the shoes on the graph dry in less than 1½ hours, and three out of four of the different shoes dry in one hour or less. FIG. 10 shows the relationship between the amount of moisture retained in the shoes and the drying time for the shoes when washed in a multi-panel laundry bag where the shoes are randomly oriented during the washing process. As shown in FIG. 10, when the shoes are randomly oriented during the washing process, it may take between one and three hours for the shoes to dry.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

While particular embodiments of the present invention have been illustrated and described, it would be obvious to those skilled in the art that various other changes and modifications can be made without departing from the spirit and scope of the invention.

What is claimed is:

1. A method of cleaning shoes in a vertical axis washing machine, said method comprising the steps of:

(a) providing a washing machine having a vertical axis tub;

(b) providing at least one shoe having a sole;

(c) providing a device for orienting said at least one shoe in the tub of said washing machine, which maintains said at least one shoe in a particular orientation throughout the washing process;

(d) positioning said device in the tub of said washing machine with said at least one shoe therein; and (e) operating said washing machine through a washing process.

2. The method of claim 1 wherein said at least one shoe is placed in said device with said sole facing upward.

3. The method of claim 2 wherein the washing machine operates through a spin cycle, and the washing machine has an agitator inside the tub, and the agitator rotates during the spin cycle of the washing machine, and said at least one shoe is oriented so that the toe of said at least one shoe is pointing in the same direction that the agitator rotates during the spin cycle of the washing machine.

4. The method of claim 1 wherein the device for orienting said at least one shoe in the tub of the washing machine comprises a flexible bag having at least one pocket for maintaining said at least one shoe in a particular orientation.

5. The method of claim 1 wherein the washing machine has an agitator, and the device for orienting said at least one shoe in the tub of the washing machine comprises a plurality of flexible mesh pockets that are at least indirectly joined together that fit around the washing machine agitator, and are held in place on the agitator.

6. A device for orienting a shoe in the tub of a vertical axis washing machine, said device comprising a flexible bag, the flexible bag including a pocket holder for at least one shoe, adapted to maintain said at least one shoe in the washing machine with its sole facing upward.

7. A flexible bag adapted to maintain shoes in a desired orientation in a washing machine, said flexible bag comprising:

at least one web of material that is arranged to have two opposed portions wherein said opposed portions are joined together to form several pockets, said pockets being defined by side walls, a closed bottom, and ends, and said pockets providing at least two openings adapted for inserting shoes; and at least one component joined to the web and adapted to retain the pockets in a particular relationship and to release the pockets from the relationship.

8. The flexible bag of claim 7 comprising an even number of pockets for shoes, wherein the bag is configured so that the pockets are adapted for arrangement on substantially opposite sides around a washing machine agitator.

9. The flexible bag of claim 8 comprising four shoe pockets.

10. The flexible bag of claim 7 which is configured so that the pockets are disposed at least partially around the washing machine agitator when said flexible bag is placed in a washing machine.

11. The flexible bag of claim 7 wherein said at least one component comprises a snap fastening system.

12. The flexible bag of claim 7 further comprising a stiffer portion thereof which stiffer portion assists in holding the shoes in a particular position within the pockets.

13. The flexible bag as recited in claim 7, wherein the at least one component is adapted to retain the pockets in a substantially donut configuration around a washing machine agitator when the bag is placed in a washing machine.

14. The flexible bag as recited in claim 7 wherein the at least one component is adapted to retain configuration of the bag so that the pockets substantially opposite one another around a washing machine agitator when the bag is placed in a washing machine.

15. A flexible bag structure having at least two pockets adapted for holding shoes in a washing machine, wherein at least two of said pockets are joined to each other directly or indirectly and wherein each pocket includes a retaining means within the pocket for retaining a shoe in a desired orientation therein.

16. The structure of claim 15, wherein the retaining means comprises at least one pleat in a wall of each pocket.

17. The structure of claim 15, wherein the retaining means comprises an elastic band.

18. A method of cleaning shoes in a vertical axis washing machine, said method comprising the steps of:

(a) providing a washing machine having a vertical axis tub;

(b) providing at least one shoe having a sole;

(c) providing a device for orienting said at least one shoe in the tub of said washing machine, which maintains said at least one shoe in a particular orientation throughout the washing process;

(d) positioning said device in the tub of said washing machine (e) placing said at least one shoe in said device; and (f) operating said washing machine through a washing process, wherein the device for orienting said at least one shoe is a flexible containment bag.

* * * * *